US005411138A

United States Patent [19]

Klawiter

[11] Patent Number: 5,411,138

[45] Date of Patent: May 2, 1995

[54] PACKAGING FOR A TOY

[75] Inventor: Ronald R. Klawiter, Berger, Mo.

[73] Assignee: Handi-Pac, Inc., Hermann, Mo.

[21] Appl. No.: 196,524

[22] Filed: Feb. 15, 1994

[51] Int. Cl.[6] ..... B65B 61/00; B65D 5/50

[52] U.S. Cl. ..... 206/459.1; 53/410; 206/45.14; 206/335; 206/486; 206/815

[58] Field of Search ..... 206/45.19, 45.14, 45.31, 206/335, 477, 459.1, 486, 815, 493; 403/348; 446/75, 77, 78; 269/49; 53/410

[56] References Cited

U.S. PATENT DOCUMENTS

| | | | |
|---|---|---|---|
| 3,674,138 | 7/1972 | Gilmour | 206/493 |
| 4,185,739 | 1/1980 | Wilford | 206/477 |
| 4,595,097 | 6/1986 | Herstein | 206/45.19 |
| 4,905,828 | 3/1990 | Dods | 206/45.19 |
| 4,925,025 | 5/1990 | Anten et al. | 206/335 |
| 5,172,806 | 12/1992 | Mickelberg | 446/75 |

*Primary Examiner*—John Sipos

*Assistant Examiner*—Rodney A. Butler

*Attorney, Agent, or Firm*—Polster, Lieder, Woodruff & Lucchesi

[57] ABSTRACT

Packaging is provided for a toy that includes a body having bottom wall having a slot. The packaging includes bottom, top, front, back and side walls defining a box sized to receive the toy and a key. The bottom surface of the box has an opening aligned with the toy's slot so that the key may be passed through the bottom box opening into the toy's body slot. The key includes a shaft, a head at one end of the shaft, and a base at another end of the shaft. The head is sized to fit through the box opening and body slot and shaped so that the key head will remain in the toy body when the key head is rotated in the body. The base of the key is sized to prevent passage of the base through the box opening. If the toy includes a wheel operated display, the box bottom may be provided with a slot which allows access to the wheel so that the display may be operated without removing the toy from the box.

16 Claims, 1 Drawing Sheet

PACKAGING FOR A TOY

BACKGROUND OF THE INVENTION

This invention relates to packaging of toys, and in particular, to the packaging of toys having displays associated therewith.

Toys are generally placed in packaging which will provide some protection to the toy and provide a means to easily display the toy. The toys are often held in the packaging by wire elements which surround the toy and are twisted on the bottom of the packaging to hold the toy in place in the packaging. This works well for small toys. Large toys require a significant amount of wire, and, because of the shape of the toys, it may not be practical to place the wire around the toy. The wire must therefore be threaded through a portion of the toy or the toy must remain loose in the packaging. Neither of these options is desirable.

Further, many toys incorporate various types of displays, such as the light display incorporated in the devices described in copending application Ser. No. 08/196,949, filed Feb. 15, 1994 and U.S. Pat. No. 5,030,160, both of which are incorporated herein by reference. Toys incorporating such displays are chosen and bought in part because of the aesthetics of the display. Customers therefore often want to operate the display to determine if they want to buy the toy. This, however, requires removing the toy from the packaging. If the toy is secured in the packaging by wires or some other means, testing the display becomes virtually impossible.

One object of the present invention is to provide packaging for a toy having a display therein.

Another object is to provide such packaging wherein the toy can be easily secured in the packaging without the use of wires.

Another object is to provide such packaging which may be used with virtually any sized toy.

Another object is to provide such packaging wherein a display of the toy may be operated without the need to remove the toy from the packaging.

These and other objects will become apparent to those skilled in the art in light of the following disclosure and accompanying drawings.

SUMMARY OF THE INVENTION

Briefly stated, packaging for a toy having a wheel operated light display is provided. The toy includes a body having bottom wall with a slot in it. The packaging includes bottom, top, front, back and side walls defining a box sized to receive the toy and a key. The bottom wall of the box has an opening aligned with the toy's slot so that the key may be passed through the box opening into the body slot. The key includes a shaft, a head at one end of the shaft, and a base at another end of the shaft. The head is sized to fit through the box opening and body slot and shaped so that the key will remain in the toy body when the head is rotated within the body. The base of the key is sized to prevent passage of the base through the box opening. The shaft is of a sufficient length to positively retain the toy in the box. The key head has has a finger extending outwardly, at about at 90° from the long axis of the shaft. The key head extends over an inside surface of the toy's bottom wall when the key is rotated in the body. Preferably, the finger forms a cross-bar, extending across the shaft to define a T with the shaft. The base is a generally flat surface from which the shaft extends. Although it can be formed in any desired shape, the base is preferably formed as an X. The key base and a bottom surface of the box may each include indicia to enable a user to determine if the key is in a locked or unlocked position. Preferably, the box includes a pair of holes formed on opposite sides of the box key opening, and the key base includes a rib on a lower surface of the base. The rib and box holes are alignable with each other by rotation of the key.

In another aspect of the invention, the box is provided with a slot through which a wheel which operates a display of the toy is accessible. The box defines a window formed in the box's front wall through which the toy and its display are visible. If desired, a window in the top wall may also be provided. Preferably, the slot communicates with the front wall window, which remains opened. This allows for access to the display operating wheel without the need to remove the toy from the box.

DESCRIPTION OF THE PREFERRED EMBODIMENT

Figure 1:
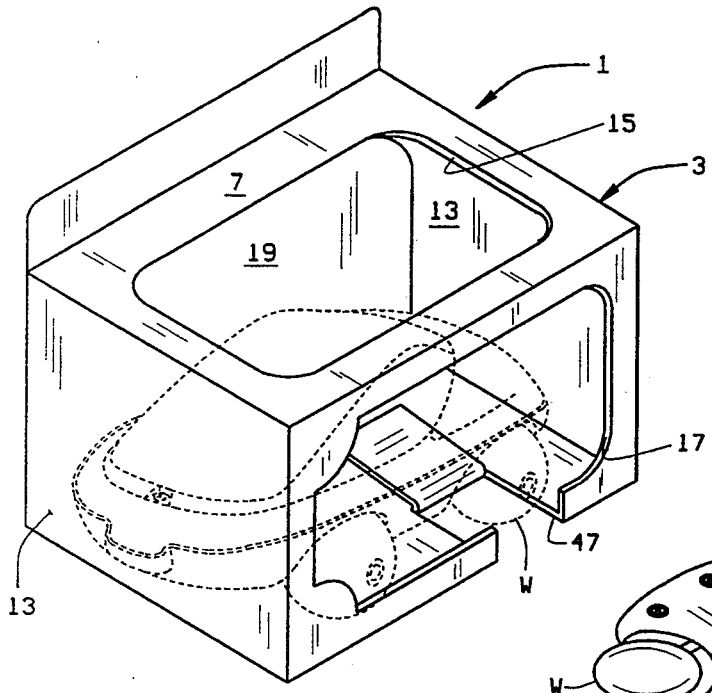
FIG. 1 is a perspective view of a packaging of the present invention having a toy contained therein.

Packaging 1 for a toy T is shown in FIG. 1. The packaging includes a box 3 having bottom 5, top 7, front 9, back 11, and side walls 13. The top wall 7 and front wall 9 have cutouts 15 and 17 which define windows through which toy T can be seen. The cutout 15 in top 7 is formed by creating a slit in the top wall which extends around three edges of what will be the window and a portion of a fourth wall and bending the portion 19 along a hinge 20 into the box 3. Portion 19, which is near back wall 11, defines a back drop on which designs, names, etc. may be placed.

The toy T is a toy having a light display L which is operated by turning wheels W of the toy. It may be a toy such as shown and described in copending applications Ser. Nos. 29/018,260 and 08/196,949, filed Feb. 2, 1994 and Feb. 15, 1994, respectively, and which are incorporated herein by reference. The toy has a bottom wall 21 having an inside surface 22 and an elongate slot 23. Slot 23 is rectangular and has a length that is greater than its width. The slot could also be formed as an oval or other shape that has one axis longer than another.

The bottom wall 5 of box 3 has an opening 25 which is in axial alignment with toy slot 23 when the toy is in place in the box. A key 27 positively retains the toy in place in box 3. Key 27 has a shaft 29 having a head 31 at one end and base 33 at an opposite end thereof. Shaft 29 is preferably rectangular, but may also be cylindrical or otherwise configured. Its largest cross-sectional dimension is no larger than the width of slot 23, so that it may be rotated in the slot. Preferably, the diagonal axis of the shaft is larger than the width of the slot 23 to prevent rotation of the key shaft in the toy, as will be explained below. Shaft 29 has an effective length substantially equal to or slightly shorter than the distance between an inner surface 22 of the toy bottom wall 21 and an outer surface 6 of the bottom wall 5 of box 3.

Head 31 includes a finger 35 which extends outwardly of shaft 29, preferably at an angle of about 90°. Finger 35 is sized to be passed through both box hole 25 and toy slot 23. It, however, has a length that is greater than the width of the slot 23 so that when the key is rotated, the head will be rotated from a position in which the head is aligned with the slot 23 to a position in which the finger overlaps a portion of the inner surface 22 of the toy's bottom wall 21 so that the key head can not fall out of the toy. Preferably, the head is formed as a cross-bar, defining two fingers 35, such that the head 31 and shaft 29 define a T. Because the diagonal length of the key shaft 29 is larger than the width of the slot 23 in toy wall 21, the key cannot rotate freely in the slot. Thus, the head cannot fall out of the toy once the finger extends over the toy bottom wall 21.

The base 33 of key 27 has a surface area larger than the area of opening 25 to prevent the the key from fully entering the box 3. The base 33 also defines a handle portion 37 which may be grasped so that the key may be rotated. Preferably, portion 37 is formed generally as an X. The handle 37, however, may be formed in any desired shape. For example, it could be in the shape of a circle or triangle.

Figure 2:
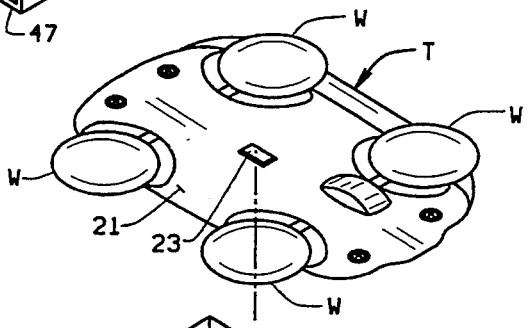
FIG. 2 is an exploded view of the packaging and toy.
Figure 2:
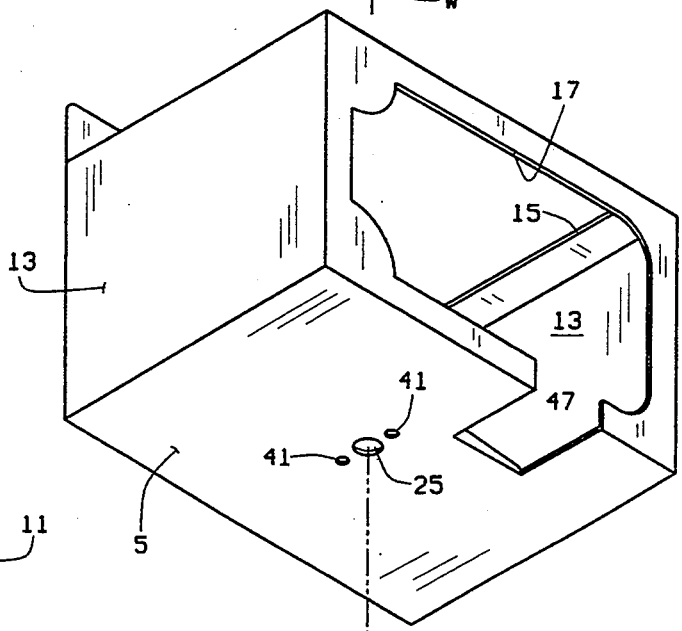
Figure 3:
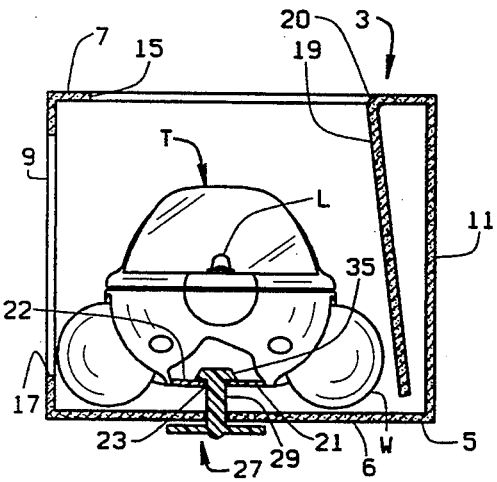
FIG. 3 is a cross-sectional view of the packaging and toy.

The base 33 includes indicia such as a rib 39, or a line or groove. The box bottom also preferably includes some indicia. This may be in the form of aligning holes 41 formed on opposite sides of opening 25 or lines drawn on the box bottom. Although two holes 41 are shown, only one hole is needed. The holes or lines are formed to define a line either parallel or perpendicular to the long axis of the toy slot. The indicia of the box and base provide an indication of the state of the key, e.g. whether it is in a locked or unlocked position. As shown in FIG. 2, when the base rib 39 and box holes 41 are aligned, the key will be in an unlocked state. Of course, the indicia could be alternately arranged. This provides the assembler with a quick indicia of the direction in which the key must be facing when it is inserted into the box to lock the toy in place.

To lock the toy in box 3, the key 27 is passed through the box opening 25 and toy slot 23 so that the key head 31 is received within the toy. As stated above, the dimensions of the key shaft prevent the key from rotating in the slot, to retain the key therein. Further, if the effective length of the key shaft is slightly shorter than the distance between the outer surface of the bottom wall of the box and the inner surface of the toy bottom wall, the bottom wall of the box may be deflected inwardly or upwardly to provide a continuous downward or outward bias to the key to help ensure, via frictional engagement between the key and the box, against accidental rotation of the key. The key is then rotated using the base 33 so that the finger 35 of the key overlaps a portion of the inside surface of the toy bottom wall. To unlock the toy, so that it may be removed from the box, the key is simply rotated to a position such that the head is aligned with the toy slot so that it may be removed from the toy.

Box 3 also includes a slot 47 formed in box bottom 5 and front wall 9 which communicates with window 17. Slot 47 is sized to allow access to a wheel W which, when turned, will operate the light display L of the toy. Although window 17 may be closed with cellophane or plastic, it is preferably left open to facilitate access to the wheel W. The provision of slot 47 allows easy access to the wheel W which operates the display L so that the toy can be operated in the store Without the need to remove the toy from the box.

As can be appreciated, the use of the key 27 to retain the toy in the box provides a quick and easy method of securing the toy in the box without the use of the usual wires. Further, the packaging provides a manner for testing of the toy while it is still in the packaging. This will eliminate the need for customers to open the box, and hence mar the packaging, to test the toy.

Variations, within the scope of the appended claims, will be apparent to those skilled in the art. For example, the head and shaft could be formed to define an upside down L. The inner surface of the toy bottom wall can be provided with channels or bumps to define a temporary seat for the fingers of the key head, or the inner surface of the toy can be provided with wedges or sloped ramps up which the fingers ride to ensure a snug engagement when the head is in its holding position to prevent rotation of the key. Alternatively, the an upper surface of the key base could be provided with dimples which engage the alignment holes 41 to similarly prevent rotation of the key. These examples are merely illustrative.

I claim:

1. Packaging for a toy including a body having a bottom wall, the bottom wall defining a slot having a first axis which is greater in length than a second axis; the packaging including bottom, top, front, back and side walls defining a box sized to receive the toy and a key; the bottom wall of said box having an opening aligned with the slot of said toy bottom wall when said toy is in said box;

said key including a shaft, a head at one end of said shaft and a base at another end of said shaft, said head being sized to fit through said box opening and toy body slot and shaped to retain said key head in said body when said key head is rotated in said body, said head having a length smaller than said toy slot first axis and greater than said toy slot second axis;

said key base being sized to prevent passage of said base through said box opening.

2. The packaging of claim 1 wherein said key shaft being of an effective length no greater than approximately equal to the distance between an inner surface of said toy bottom wall and an outer surface of said box bottom wall.

3. The packaging of claim 1 wherein said key head has a finger extending outwardly from said shaft.

4. The packaging of claim 3 wherein said finger extends generally 90° from said shaft.

5. The packaging of claim 4 wherein said finger extends across said shaft, said finger and said shaft generally defining a T.

6. The packaging of claim 3 wherein said base comprises a generally flat surface from which said shaft extends.

7. The packaging of claim 6 wherein said base is formed generally as an X.

8. Packaging for a toy including a body having a bottom wall including a slot; the packaging including bottom, top, front, back and side walls defining a box sized to receive the toy and a key; the bottom wall of said box having an opening aligned with the slot of said toy bottom wall when said toy is in said box;

said key including a shaft, a head at one end of said shaft and a base at another end of said shaft, said head being sized to fit through said box opening and toy body slot in an unlocked orientation and shaped to retain said key head in said body when said key head is rotated to a locked position in said body; said key head having a finger extending outwardly from said shaft; said key base comprising a generally flat surface from which said shaft extends;

said key base being sized to prevent passage of said base through said box opening;

said base and said box bottom surface each includes indicia to enable a user to determine if the key is in a locked or an unlocked position.

9. The packaging of claim 8 wherein said indicia includes a hole in said box and a rib on said base, said rib being alignable with said box aligning hole by rotation of said key.

10. The packaging of claim 1 wherein said toy includes at least a pair of wheels and a display operated by rotation of said wheels; said box including a window on said front wall through which said toy is visible and a slot in said bottom through which at least one wheel is accessible without removing said toy from said packaging, whereby said wheel may be rotated by a customer to operate said display while said toy is in said packaging.

11. The packaging of claim 10 wherein said slot communicates with said front wall window.

12. The packaging of claim 11 wherein said front wall window is opened.

13. The packaging of claim 1 including means for preventing rotation of said key when said key has been passed through said toy bottom wall slot.

14. The packaging of claim 13 wherein said rotation prevention means includes said key shaft, said key shaft having a dimension greater than a width of said slot.

15. The packaging of claim 14 wherein said shaft is rectangular, said dimension being a diagonal dimension of said shaft.

16. A method for securing a toy in a box, said toy including a bottom wall defining a slot, the slot having a first axis and a second axis, the first axis being longer than the second axis; said box including top, bottom, from, back, and side walls; said box bottom having an opening in axial alignment with said toy bottom slot; the method comprising:

passing a key through said box bottom opening and said toy bottom slot, said key including a shaft, a base having a surface larger than said box bottom opening and formed at one end of said shaft, and a head formed at another end of said shaft, said head having a finger extending from said shaft, said finger having a length less than the length of said first axis of said slot and greater than the second axis of said slot; and rotating said key, after said head is fully received in said toy body so that said head rotates in said toy body, whereby said key head extends across a portion of an inner surface of said bottom of said toy within said toy to retain said toy in said box.

* * * * *

UNITED STATES PATENT AND TRADEMARK OFFICE

CERTIFICATE OF CORRECTION

PATENT NO. : 5,411,138
DATED : May 2, 1995
INVENTOR(S) : Ronald R. Klawiter

It is certified that error appears in the above-indentified patent and that said Letters Patent is hereby corrected as shown below:

| Column | Line | |
|---|---|---|
| 1 | 63 | "has has" should be has |
| 3 | 18 | "the the" should be the |
| 4 | 1 | "Without" should be without |
| 4 | 19 | "the an upper" should be the upper |
| 6 | 14 | "from, back" should be front, back |

Signed and Sealed this

Eighth Day of August, 1995

*Attest:*

*Attesting Officer*

BRUCE LEHMAN

*Commissioner of Patents and Trademarks*